US007775419B2

(12) United States Patent
Bale

(10) Patent No.: US 7,775,419 B2
(45) Date of Patent: Aug. 17, 2010

(54) NON-DIASSEMBLING INTERSECTING PARTITION MATRIX AND METHOD OF MANUFACTURE

(75) Inventor: Michael R. Bale, Allegan, MI (US)

(73) Assignee: Bradford Company, Holland, MI (US)

( * ) Notice: Subject to any disclaimer, the term of this patent is extended or adjusted under 35 U.S.C. 154(b) by 104 days.

(21) Appl. No.: 12/352,777

(22) Filed: Jan. 13, 2009

(65) Prior Publication Data

US 2010/0179040 A1 Jul. 15, 2010

(51) Int. Cl.
*B65D 5/492* (2006.01)
*B65D 25/04* (2006.01)
*B31B 11/00* (2006.01)

(52) U.S. Cl. ..... 229/120.36; 229/120.38; 493/91; 493/912

(58) Field of Classification Search ..... 229/120.31, 229/120.36, 120.38; 217/22, 23, 30, 31, 217/32, 33; 493/90, 91, 128, 129, 130, 131, 493/132, 912
See application file for complete search history.

(56) References Cited

U.S. PATENT DOCUMENTS 347,835 A * 8/1886 Shibley ..... 217/31
669,829 A * 3/1901 Grant, Jr. ..... 229/120.31
1,120,752 A * 12/1914 Smiley ..... 229/120.36
1,697,231 A * 1/1929 Einson ..... 229/120.38
2,749,014 A * 6/1956 Russell et al. ..... 229/120.36
3,942,709 A 3/1976 Gepfer
4,194,675 A 3/1980 Peters, Jr.
5,052,580 A 10/1991 Khoury
5,332,149 A 7/1994 Gepfer
5,626,284 A 5/1997 Franzen
6,669,082 B1 12/2003 Meyer
2006/0124713 A1 * 6/2006 Bos ..... 229/120.36

FOREIGN PATENT DOCUMENTS

GB 2055349 A * 3/1981 ..... 229/120.36

* cited by examiner

*Primary Examiner*—Gary E Elkins
(74) *Attorney, Agent, or Firm*—Wood, Herron & Evans, LLP

(57) ABSTRACT

A collapsible, non-disassembling intersecting partition assembly for insertion into a container divides the space inside the container into individual cells for holding products. The assembly comprises a plurality of first slotted partitions intersecting with a plurality of second slotted partitions to form a collapsible matrix. Each of the first slotted partitions has opposed slots extending inwardly from opposed edges of the partition to facilitate folding the partition. An outer portion or tab of each folded partition is secured to one of the other partitions to prevent disassembly of the matrix. Each of the partitions has hooks and notches to help hold the assembly together.

17 Claims, 6 Drawing Sheets

NON-DIASSEMBLING INTERSECTING PARTITION MATRIX AND METHOD OF MANUFACTURE

FIELD OF THE INVENTION

The present invention relates to a non-disassembling partition assembly for dividing the space inside a container or box.

BACKGROUND OF THE INVENTION

In the storage, shipment or display of parts or merchandise, it is a common practice to divide the interior of a box or container into a plurality of individual cells. The interior of a box or container is typically separated by a series of dividers, one set of parallel dividers being orthogonal to a second set of dividers. The dividers separate the interior of the container into a plurality of individual cells each of which is intended to hold a separate item for display or shipment. The division of the interior of the box or container helps prevent the items therein from contacting one another and breaking during shipping. The division or partitioning of the container also aids in the loading and unloading of the items therein, as well as inventorying the contents of each box or container.

The dividers typically are slotted and arranged in an orthogonal relationship to divide the interior of the box or container into a desired number of cells. The dividers are slotted in a manner that enables the dividers to engage with one another at the location of the slots so that the dividers form an orthogonal grid or matrix. Typically the dividers are made of the same material as the material of the box or container, plastic or paperboard. However, the dividers may be constructed of any suitable material with sufficient rigidity to prevent the contents of the container from contacting one another and being damaged.

A desirable partition assembly for many applications is one that is collapsible but not fully disassembling; the individual dividers of the assembly being affixed to each other. Such a non-disassembling assembly may be lifted as a whole out of a box without the operator worrying about the dividers separating from one another and may be collapsed for storage purposes.

Several U.S. patents disclose non-disassembling, collapsible partition assemblies which separate the interior of a box or container into a plurality of cells. The collapsible divider assemblies disclosed in these patents generally have a first set of dividers extending in one direction intersecting orthogonally with a second set of dividers extending in a second direction.

One such non-disassembling partition assembly is disclosed in U.S. Pat. No. 3,942,709 to Gepfer. The Gepfer '709 patent discloses a slotted partition assembly having two parallel longitudinal partitions intersecting a cross partition and a "tying" partition. The end portions of the longitudinal partitions are bent along score lines and secured to the "tying" strip by a glue bond so as to prevent disassembly of the assembled partition assembly. As seen in FIGS. 1-4 of the Gepfer '709 patent, the partition assembly has three different types of panels or partitions. They include two longitudinal partitions, one cross partition, and one "tying strip" which is different than the cross partition. Each longitudinal partition is different than cross partition because each longitudinal partition lacks a relieved portion or notch at the end of the score line, and therefore cannot receive a locking protrusion or hook of one of the longitudinal partitions shown in FIG. 2.

One disadvantage of the assembled collapsible partition assembly of the Gepfer '709 patent is that the partition assembly has a tendency or inclination to collapse. The partition assembly does not want to stay in a position in which the partitions are orthogonal to each other. Without product inside the cells defined by the intersecting partitions, the partition assembly of the Gepfer '709 patent will want to collapse. Therefore, prior to the present invention, there was a need for a collapsible non-disassembling partition assembly which when expanded would stay in an expanded condition with the partitions in orthogonal relationship to each other.

For manufacturing purposes, it is desirable to manufacture a collapsible non-disassembling partition assembly with fewer styles or configurations of partitions or panels to reduce costs and complexity. Prior to the present invention, there was a need for a collapsible non-disassembling partition assembly which could be manufactured with only two configurations of partitions, rather than three or more.

SUMMARY OF THE INVENTION

The collapsible, non-disassembling intersecting partition assembly of the present invention comprises a plurality of first slotted partitions intersecting with a plurality of second slotted partitions. The slotted partitions are preferably made of paperboard, but may be made of any desired material.

Each of the first slotted partitions have a plurality of spaced first slots extending inwardly from a first edge of the first slotted partition, a plurality of rectangular notches aligned with the first slots and extending inwardly from a second edge of the first slotted partition opposite the first edge of the first slotted partition. One of the notches has a second slot extending inwardly from the rectangular notch, the second slot being of a length less than the length of a corresponding first slot and aligned with the corresponding first slot, wherein the first and second slots define a folding axis dividing the first slotted partition into a small portion and a large portion. Each of the second slotted partitions has a plurality of slots extending inwardly from a first edge of the second slotted partition and a plurality of rectangular notches aligned with the slots of the second slotted partition and extending inwardly from a second edge of the second slotted partition opposite the first edge of the second slotted partition. The small portions of the first slotted partitions are folded and secured to an outer surface of one of the second slotted partitions. One preferred method of attaching the first and second slotted partitions together in a non-disassembling relationship while allowing the matrix or array to collapse is to use adhesive secured to one surface of the small portions of the first slotted partitions. However, any other form of securement may be used such as staples.

Each slot of the second slotted partitions and each first slot of the first slotted partitions has an introductory triangular cutout and a hook located in the triangular cutout. These triangular cutouts help an operator assemble the partitions together. Once the first and second slotted partitions have engaged each other, the hooks of each of the first slotted partitions reside in the rectangular notches of the second slotted partitions. Similarly, when assembled, the hooks of the second slotted partitions reside in the rectangular notches of the first slotted partitions.

In one embodiment, the collapsible, non-disassembling intersecting partition assembly comprises two first slotted partitions and two second slotted partitions. However, a collapsible, non-disassembling intersecting partition assembly constructed in accordance with the present invention may comprise any number of slotted partitions.

In one embodiment, each of said first slotted partitions has a score line extending between said first and second slots to facilitate folding the first slotted partition.

The method of forming the collapsible, non-disassembling intersecting partition assembly comprises engaging the engaging the slots of the second slotted partitions with the first slots of the first slotted partitions at intersections to form the matrix or assembly. The next step comprises folding each of the first slotted partitions along its folding axis. The next step comprises attaching the small portion of the first slotted partition to the second slotted partition to permanently secure the intersecting partitions in a non-disassembling relationship. According to one aspect of this invention, the step of attaching the small portion of the first slotted partitions to one of the second slotted partitions comprises placing adhesive on one surface of the small portion of each of the first slotted partitions before folding the first slotted partition along its folding axis and contacting the small portion of the first slotted partition to the second slotted partition.

DETAILED DESCRIPTION OF THE INVENTION

Figure 1:
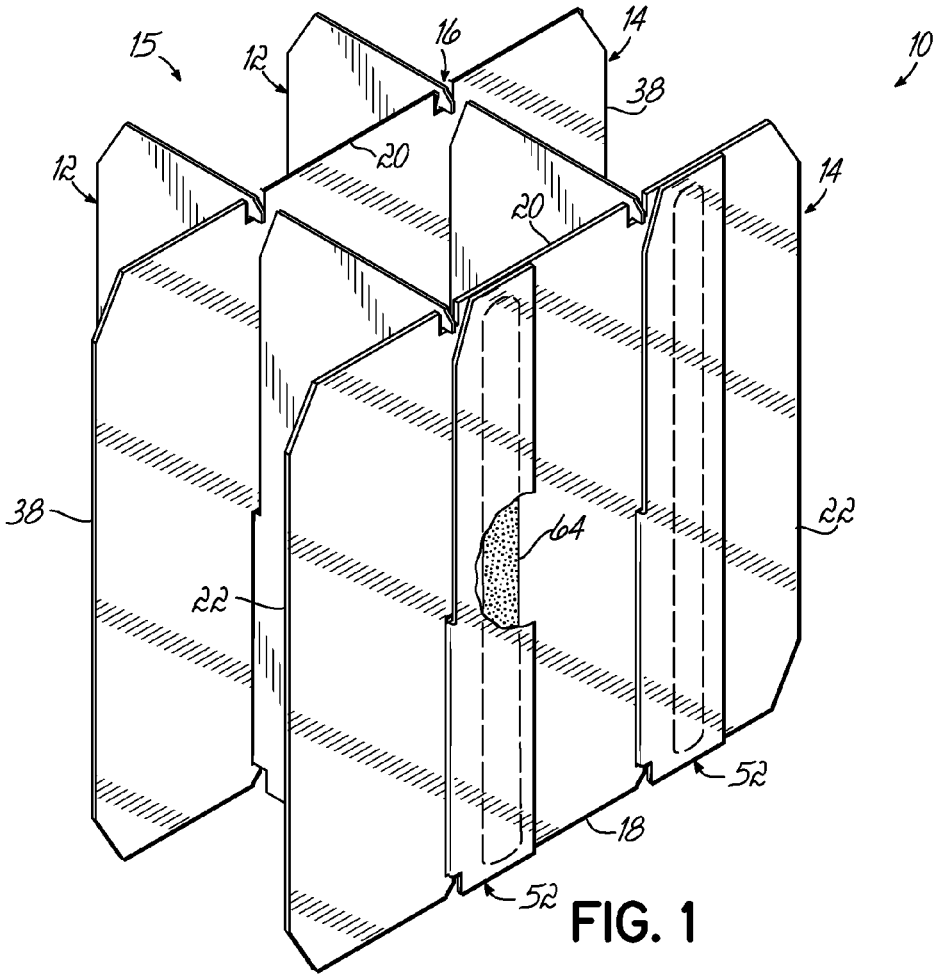
FIG. 1 is a perspective view of one embodiment of a non-disassembling intersecting partition matrix in accordance with the present invention in an assembled condition.

Referring to the drawings and particularly to FIG. 1, a collapsible, non-disassembling intersecting partition matrix or assembly 10 for use in a container or box is illustrated in an expanded condition. The collapsible, non-disassembling intersecting partition matrix or assembly 10 comprises a plurality of first slotted partitions 12 and a plurality of second slotted partitions 14 intersecting with the first slotted partitions 12 at intersections 16. Although the drawings show a collapsible, non-disassembling intersecting partition matrix or assembly 10 made with two first slotted partitions 12 and two second slotted partitions 14, any number of partitions may be used in accordance with this invention. As shown in FIG. 1, the illustrated partition matrix 10 defines six individual holding cells 15 when in an expanded condition.

Figure 2:
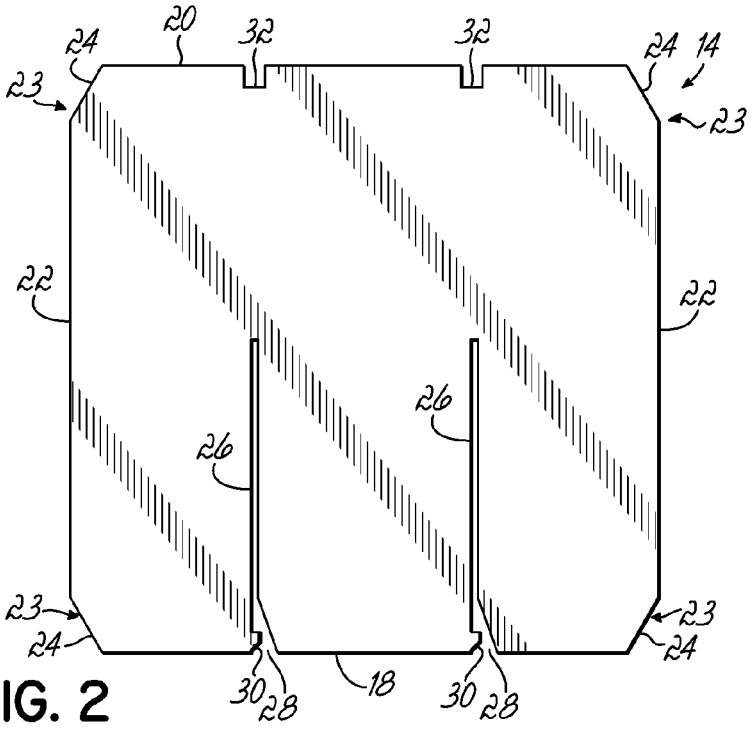
FIG. 2 is an elevational view of one of the second partitions used in the non-disassembling intersecting partition matrix of FIG. 1.

Each of the second slotted partitions 14 is identical, one being shown in FIG. 2. Each second slotted partition 14 has a first or bottom edge 18, a second or top opposed edge 20 and a pair of side edges 22. Each of the corners 23 is cut off by a diagonal cut 24. Extending inwardly from the first edge 18 are a plurality of spaced first slots 26 extending inwardly from the first edge 18 (towards the second edge 20). Each first slot 26 has an introductory triangular cutout 28 proximate the first edge 18 of the partition 14 and a hook 30 located in the triangular cutout 28 as shown in FIG. 2. A plurality of rectangular notches 32 extend inwardly from the second edge 20 of the partition 14. Each rectangular notch 32 is aligned with one of the first slots 26 and is sized to receive and retain one of the hooks 46 of one of the first slotted partitions 12 in a manner described below.

Figure 3:
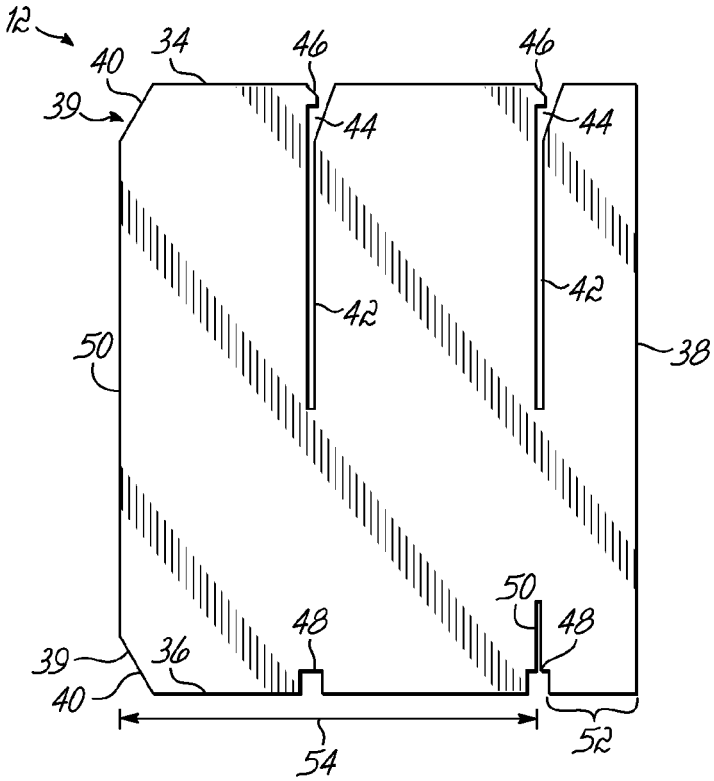
FIG. 3 is an elevational view of one of the first partitions used in the non-disassembling intersecting partition matrix of FIG. 1.

According to one embodiment, each of the first slotted partitions 12 is identical, one of the first slotted partitions 12 being shown in FIG. 3. As seen in FIG. 3, each first slotted partition 12 has a first or top edge 34, a second or bottom opposed edge 36 and a pair of side edges 38. Two of the corners 39 are cut off by diagonal cuts 40. Extending inwardly from the first edge 34 are a plurality of spaced first slots 42 extending inwardly from the first edge 34 (towards the second edge 36). Each first slot 42 has an introductory triangular cutout 44 proximate the first edge 34 of the partition 12 and a hook 46 located in the triangular cutout 44 as shown in FIG. 3. A plurality of rectangular notches 48 extend inwardly from the second edge 36 of the partition 12. Each rectangular notch 48 is aligned with one of the first slots 42 and is sized to receive and retain one of the hooks 30 of one of the second slotted partitions 14 in a manner described below. A second slot 50 extends inwardly from one of the rectangular notches 48 (towards the first edge 34) and is aligned with one of the first slots 42. These aligned first and second slots 42, 50 define a folding axis A which divides the first slotted partition 12 into a small portion 52 and a large portion 54.

Figure 3A:
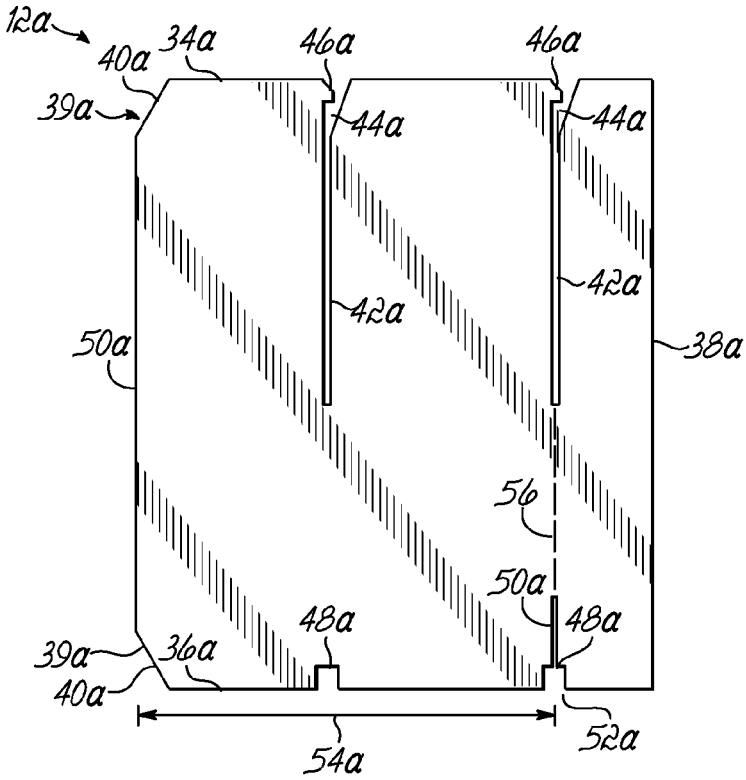
FIG. 3A is an elevational view of an alternative embodiment of one of the first partitions used in an alternative embodiment of non-disassembling intersecting partition matrix.

FIG. 3A illustrates another version of a first slotted partition 12*a* similar to first slotted partition 12 described above and shown in FIG. 3. As seen in FIG. 3A, each first slotted partition 12*a* has a first edge 34*a*, a second opposed edge 36*a* and a pair of side edges 38*a*. Two of the corners 39*a* are cut off by diagonal cuts 40*a*. Extending inwardly from the first edge 34*a* are a plurality of spaced first slots 42*a* extending inwardly from the first edge 34*a* (towards the second edge 36*a*). Each first slot 42*a* has an introductory triangular cutout 44*a* proximate the first edge 34*a* of the partition 12*a* and a hook 46*a* located in the triangular cutout 44*a* as shown in FIG. 3A. A plurality of rectangular notches 48*a* extend inwardly from the second edge 36*a* of the partition 12*a*. Each rectangular notch 48*a* is aligned with one of the first slots 42*a* and is sized to receive and retain one of the hooks 30*a* of one of the second slotted partitions 14*a* in a manner described below. A second slot 50*a* extends inwardly from one of the rectangular notches 48*a* (towards the first edge 34*a*) and is aligned with one of the first slots 42*a*. These aligned first and second slots 42*a*, 50*a* define a folding axis A which divides the first slotted partition 12*a* into a small portion 52*a* and a large portion 54*a*. A score line 56 extends between the first and second slots 42*a*, 50*a* and is located along the folding axis A. The score line 56 comprises a plurality of spaced slits 58 in which no material is removed. On the other hand, in all of the partitions of all embodiments material is removed to make each of the slots.

Figure 4:
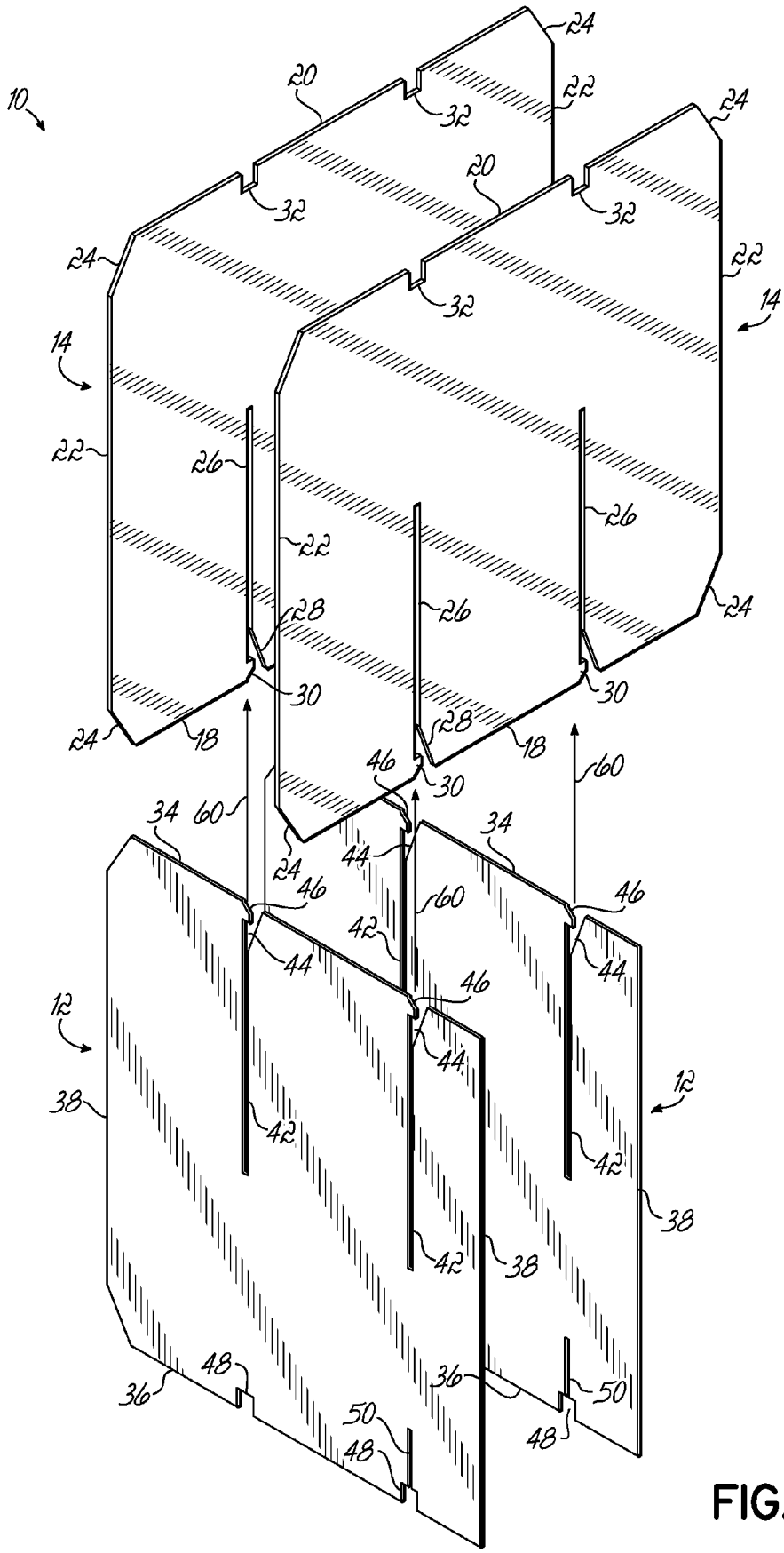
FIG. 4 is a partially disassembled perspective view of the non-disassembling intersecting partition matrix of FIG. 1 prior to assembly.

FIG. 4 illustrates a pair of first slotted partitions 12 oriented the same direction and spaced from each other. FIG. 4 further illustrates a pair of second slotted partitions 14 oriented the same direction and spaced from each other above the first slotted partitions 12. As illustrated in FIG. 4, the lower first slotted partitions 12 are moved upwardly in the direction of arrows 60 into engagement with the second slotted partitions 14. More particularly, the first slots 42 of the first slotted partitions 12 are engaged with the slots 26 of the second slotted partitions 14.

Figure 5:
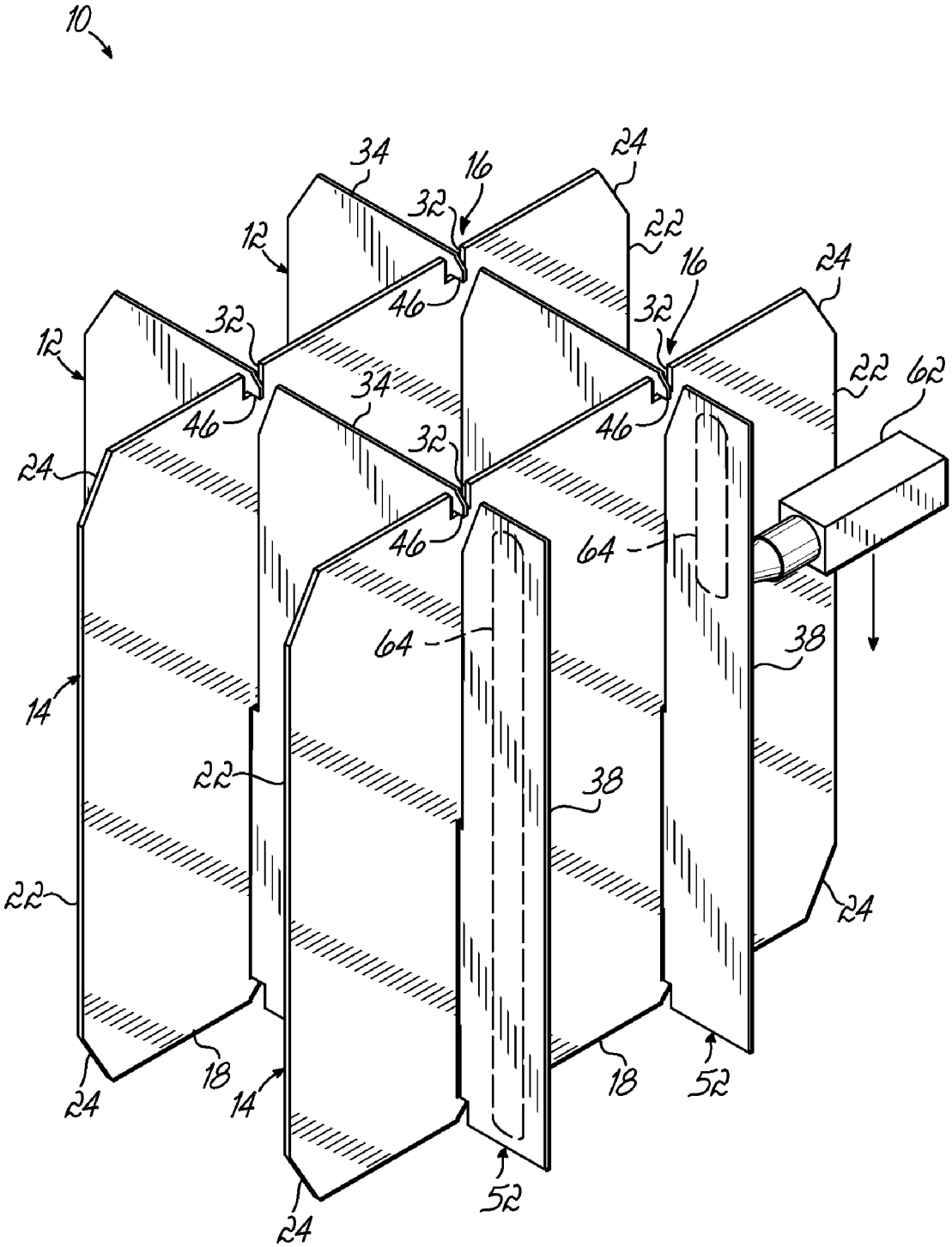
FIG. 5 is a perspective view of the non-disassembling intersecting partition matrix of FIG. 1 in a partially assembled condition.

As shown in FIG. 5, the first and second slotted partitions are pushed or brought together until the hooks 46 of the first slotted partitions 12 are located in the rectangular notches 32 of the second slotted partitions 14. Similarly, the hooks 30 of the second slotted partitions 14 are located in the rectangular notches 48 of the first slotted partitions 12. The engagement of the hooks 30, 46 inside the rectangular notches 48, 32, respectively helps keep the partitions 12, 14 of the matrix 10 in place when the matrix or assembly is in a partially or fully assembled condition.

Figure 6:
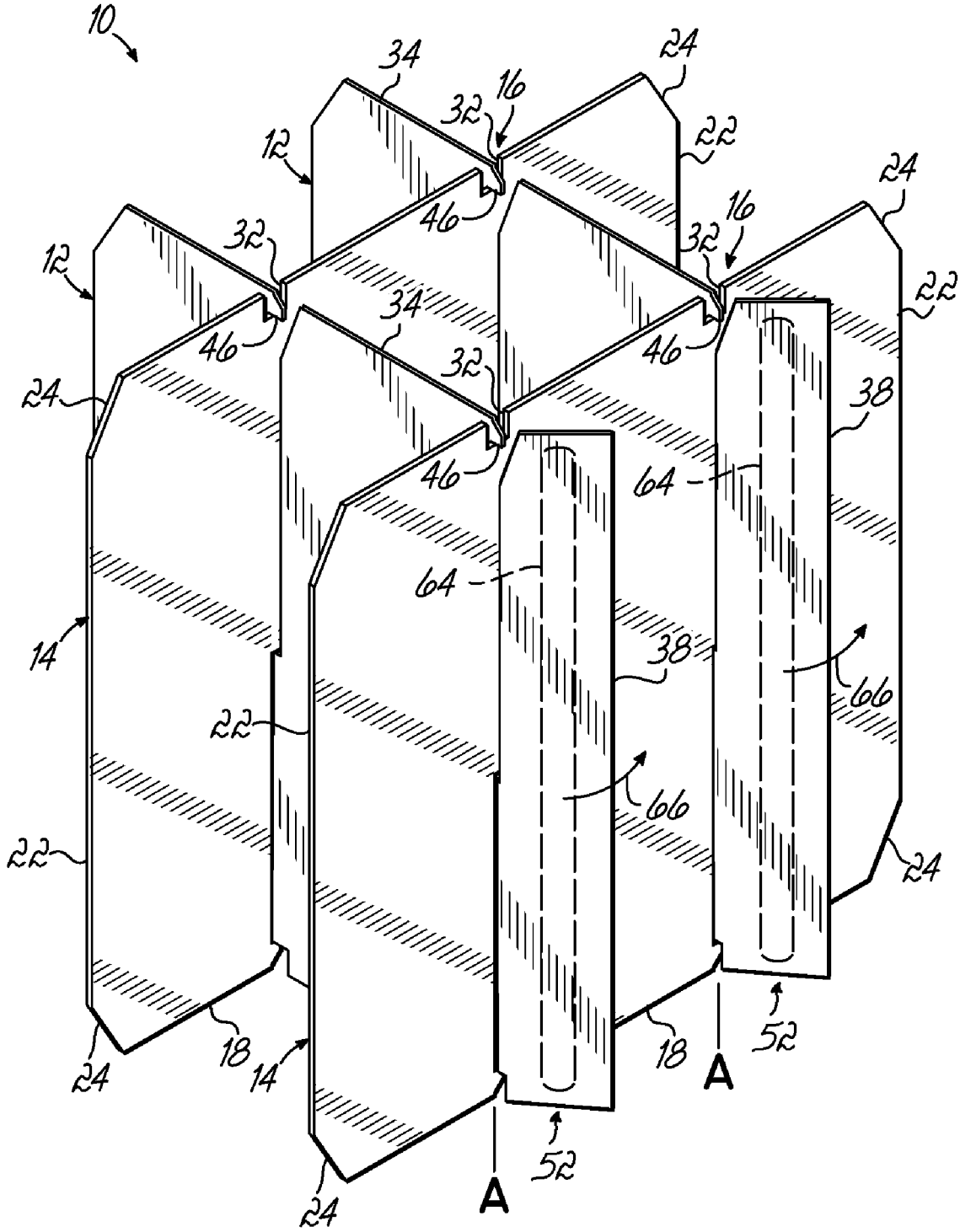
FIG. 6 is a perspective view of the non-disassembling intersecting partition matrix of FIG. 1 in a partially assembled condition after the step shown in FIG. 5 is completed.

FIG. 5 illustrates a nozzle 62 applying adhesive 64 to one surface of the small portions 52 of the first slotted partitions 12. Once a sufficient amount of adhesive 64 is applied to one surface of the small portions 52 of the first slotted partitions 12, the small portion 52 of each first slotted partition 12 is pivoted, bent or folded about the folding axis A in the direction of the arrows 66 of FIG. 6. Although the drawings show the adhesive 64 in a generally rectangular configuration, the adhesive may be applied in any desired area or areas such as in spaced circular dots, for example. The adhesive may be applied at any desired temperature.

Figure 7:
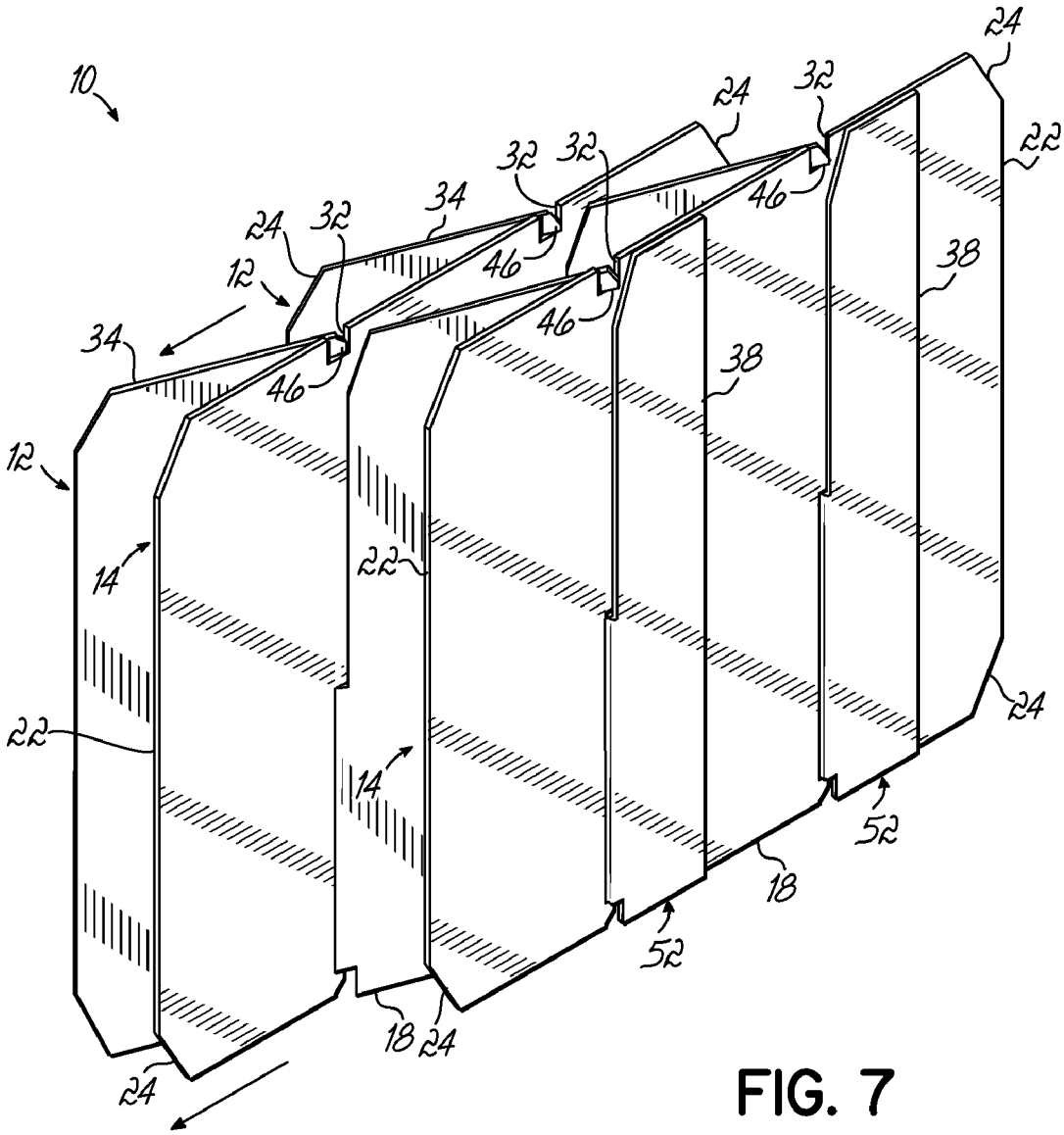
FIG. 7 is a perspective view of the non-disassembling intersecting partition matrix of FIG. 1 in a partially collapsed condition.

As shown in FIGS. 1 and 7, the adhesive 64 is allowed to cool or dry to permanently secure the small portions 52 of the first slotted partitions 12 to an outermost second slotted partition 14. FIG. 7 shows the non-disassembling intersecting partition matrix 10 of FIG. 1 in a partially collapsed condition for shipping or storage.

While I have described only a few embodiments of my invention, I do not intend to be limited except by the scope of the following claims.

What is claimed is:

1. A method of forming a non-disassembling intersecting partition matrix, said matrix comprising a plurality of first slotted partitions intersecting with a plurality of second slotted partitions, each of the first slotted partitions having a plurality of spaced first slots extending inwardly from a first edge of the first slotted partition, a plurality of rectangular notches aligned with said first slots and extending inwardly from a second edge of said first slotted partition opposite said first edge of said first slotted partition, one of said notches having a second slot extending inwardly from said rectangular notch and aligned with a corresponding first slot, wherein said first and second slots define a folding axis dividing said first slotted partition into a small portion and a large portion, each of said second slotted partitions having a plurality of slots extending inwardly from a first edge of the second slotted partition and a plurality of rectangular notches aligned with said slots of said second slotted partition and extending inwardly from a second edge of said second slotted partition opposite said first edge of said second slotted partition, said method comprising the steps of:

engaging said slots of said second slotted partitions with said first slots of said first slotted partitions at intersections to form the matrix;

folding each of the first slotted partitions along its folding axis;

attaching the small portion of the first slotted partition to the second slotted partition to permanently secure the intersecting partitions in a non-disassembling relationship.

2. The method of claim 1 wherein attaching the small portion of the first slotted partition to the second slotted partition comprises gluing the small portion of the first slotted partition to the second slotted partition.

3. The method of claim 2 wherein folding each of the first slotted partitions along its folding axis comprises folding the first slotted partition along a score line.

4. The method of claim 1 wherein attaching the small portion of the first slotted partition to the second slotted partition comprises adhesively securing the small portion of the first slotted partition to the second slotted partition.

5. The method of claim 1 further comprising inserting hooks located at outer ends of the first slots of the first slotted partitions into the notches of the second slotted partitions.

6. The method of claim 5 further comprising inserting hooks located at outer ends of the slots of the second slotted partitions into the notches of the first slotted partitions.

7. A method of forming a non-disassembling intersecting partition matrix, said matrix comprising a plurality of first slotted paperboard partitions intersecting with a plurality of second slotted paperboard partitions, each of the first slotted partitions having a plurality of spaced first slots extending inwardly from a first edge of the first slotted partition, a plurality of rectangular notches aligned with said first slots and extending inwardly from a second edge of said first slotted partition opposite said first edge of said first slotted partition, one of said notches having a second slot extending inwardly from said rectangular notch, being of a length less than the length of a corresponding first slot and aligned with the corresponding first slot, wherein said first and second slots define a folding axis dividing said first slotted partition into a small portion and a large portion, each of said second slotted partitions having a plurality of slots extending inwardly from a first edge of the second slotted partition and a plurality of rectangular notches aligned with said slots of said second slotted partition and extending inwardly from a second edge of said second slotted partition opposite said first edge of said second slotted partition, said method comprising the steps of:

engaging said slots of said second slotted partitions with said first slots of said first slotted partitions at intersections;

placing adhesive on one surface of the small portion of each of the first slotted partitions;

folding each of the first slotted partitions along its folding axis;

contacting the small portion of the first slotted partition to the second slotted partition to permanently secure the intersecting partitions in a non-disassembling relationship.

8. The method of claim 7 wherein folding each of the first slotted partitions along its folding axis comprises folding the first slotted partition along a score line.

9. The method of claim 7 wherein attaching the small portion of the first slotted partition to the second slotted partition comprises adhesively securing the small portion of the first slotted partition to the second slotted partition.

10. The method of claim 7 further comprising inserting hooks located at outer ends of the first slots of the first slotted partitions into the notches of the second slotted partitions.

11. The method of claim 10 further comprising inserting hooks located at outer ends of the slots of the second slotted partitions into the notches of the first slotted partitions.

12. A non-disassembling intersecting partition matrix comprising:

a plurality of first slotted paperboard partitions intersecting with a plurality of second slotted paperboard partitions, each of the first slotted partitions having a plurality of spaced first slots extending inwardly from a first edge of the first slotted partition, a plurality of rectangular notches aligned with said first slots and extending inwardly from a second edge of said first slotted partition opposite said first edge of said first slotted partition, one of said notches having a second slot extending inwardly from said rectangular notch, said second slot being of a length less than the length of a corresponding first slot and aligned with the corresponding first slot, wherein said first and second slots define a folding axis dividing said first slotted partition into a small portion and a large portion, each of said second slotted partitions having a plurality of slots extending inwardly from a first edge of the second slotted partition and a plurality of rectangular notches aligned with said slots of said second slotted partition and extending inwardly from a second edge of said second slotted partition opposite said first edge of said second slotted partition, said small portions of said first slotted partitions being folded and secured to an outer surface of one of the second slotted partitions.

13. The non-disassembling intersecting partition matrix of claim 12 wherein said small portions of said first slotted partitions are adhesively secured to one of said second slotted partitions.

14. The non-disassembling intersecting partition matrix of claim 12 wherein each of said first slots of each of said first slotted partitions and each slot of said second slotted partitions has an introductory triangular cutout and a hook located in said introductory triangular cutout.

15. The non-disassembling intersecting partition matrix of claim 12 wherein each of said hooks of each of said first slotted partitions is located in one of said notches of one of said second slotted partitions and each of said hooks of said second slotted partitions is located in one of said notches of one of said first slotted partitions.

16. The non-disassembling intersecting partition matrix of claim 12 wherein said matrix comprises two of said first slotted partitions and two of said second slotted partitions.

17. The non-disassembling intersecting partition matrix of claim 12 wherein each of said first slotted partitions has a score line extending between said first and second slots.

* * * * *